US006554408B1

(12) United States Patent
Miki et al.

(10) Patent No.: US 6,554,408 B1
(45) Date of Patent: Apr. 29, 2003

(54) FLUID EJECTION DEVICE AND PROCESS FOR THE PRODUCTION THEREOF

(75) Inventors: Katsumasa Miki, Osaka (JP); Masaya Nakatani, Hyogo (JP); Isaku Kanno, Nara (JP); Ryoichi Takayama, Osaka (JP); Koji Nomura, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/506,751

(22) Filed: Feb. 18, 2000

Related U.S. Application Data

(63) Continuation of application No. PCT/JP99/03198, filed on Jun. 16, 1999.

(30) Foreign Application Priority Data

Jun. 18, 1998 (JP) ..... 10-171060

(51) Int. Cl.[7] ..... B41J 2/045
(52) U.S. Cl. ..... 347/70; 347/71
(58) Field of Search ..... 340/68–70, 47; 310/324

(56) References Cited

U.S. PATENT DOCUMENTS

| | | | | | |
|---|---|---|---|---|---|
| 4,283,228 | A | * | 8/1981 | Buchanan et al. | 501/134 |
| 4,312,008 | A | | 1/1982 | Taub et al. | |
| 5,530,465 | A | * | 6/1996 | Hasegawa et al. | 347/70 |
| 5,612,725 | A | * | 3/1997 | Okimoto | 347/71 |
| 5,874,975 | A | * | 2/1999 | Hotomi et al. | 347/70 |
| 6,260,960 | B1 | * | 7/2001 | Hashizume et al. | 347/70 |

FOREIGN PATENT DOCUMENTS

| | | | | |
|---|---|---|---|---|
| EP | 0736915 | | 10/1996 | |
| JP | 04099639 | * | 3/1992 | 347/72 |
| JP | 5-286131 | | 11/1993 | |
| JP | 6-143559 | | 5/1994 | |
| JP | 9-267479 | | 10/1997 | |
| JP | 9-286101 | | 11/1997 | |
| JP | 10-290033 | | 10/1998 | |

OTHER PUBLICATIONS

International Search Report corresponding to application No. PCT/JP99/03198 dated Sep. 21, 1999.
European Search Report, application No. 99957038.5, dated Sep. 5, 2001.

* cited by examiner

*Primary Examiner*—John Barlow
*Assistant Examiner*—Michael S Brooke
(74) *Attorney, Agent, or Firm*—RatnerPrestia

(57) ABSTRACT

A fluid ejection device, such as for an ink jet printer or the like, having increased increasing nozzle density. A through-hole (15) is provided in a glass substrate (18) to which a second silicon substrate (19) is directly bonded to form an ink outlet (14). The first silicon substrate (17) is etched to form a pressure chamber (12), an ink channel (13) and an ink inlet (16), and bonded directly to the glass substrate (18). A piezoelectric thin film (11), having a conductive, elastic body (20), is bonded to the first substrate covering the pressure chamber (12). The elastic body (20) is sandwiched between the piezoelectric thin film (11) and a resin layer (25). The second substrate (19) has a thickness of less than about 0.8 mm in a range of thickness comprising about 1.2 to about 1.9 times (rg-rs), wherein rg is the diameter of the wide end of the through-hole (15) and rs is the diameter of the narrow end of the through-hole (15).

20 Claims, 15 Drawing Sheets

FLUID EJECTION DEVICE AND PROCESS FOR THE PRODUCTION THEREOF

CROSS-REFERENCE TO RELATED APPLICATIONS

This application is a continuation of International Application Number PCT/JP99/03198, filed Jun. 16, 1999, incorporated herein by reference.

FIELD OF THE INVENTION

The present invention relates to a fluid ejection device to be used in a printhead of an ink jet printer for ejecting fluid, such as ink, in a well-controlled manner, and a process for the production thereof.

BACKGROUND OF THE INVENTION

With the development of a computerized society in recent years, demand for office automation or OA devices has been growing rapidly. Under such circumstances, demand for various kinds of printers has become increasingly stronger, not only with respect to their performance as a recording means but for higher-speed printing and improved picture quality.

In widely used ink jet printers, the ink jet printhead of the on demand system which enables a high-speed ejection of the ink at the user's will, is critical for the performance of the printer. The ink jet printhead, in general, comprises an ink channel, a pressure chamber where ink is pressurized, a pressurizing means for the ink such as an actuator, and an ink outlet through which the ink is ejected. To realize an on-demand ink jet printer system, a pressurizing means with high controllability is required. Most conventional systems employ a bubble ejecting method, also known as a heating method, whereby the ink is heated to produce bubbles that eventually eject the ink, or a piezoelectric method, in which ink is directly pressurized by a deformation of a piezoelectric ceramic or the like.

FIG. 11 is a sectional perspective view showing an example of the construction of a conventional ink jet printhead. The conventional ink jet printhead consists of a piezoelectric member 111, a pressure chamber 112, an ink channel 113, an ink outlet 114, a fluid (ink) inlet 115, a first structure member 116, a second structure member 117, a third structure member 118, a diaphragm 119 and individual electrodes 120.

On a first side of the piezoelectric member 111, individual electrodes 120*a*, 120*b*, and so on are formed thereon. On a second side thereof electrodes are also formed in the same manner, 120au, 120bu, and so on. The piezoelectric member 111 is bonded to the diaphragm 119 via the electrode on the second side.

The diaphragm 119 and the first structure member 116, the second structure member 117 and the third structure member 118 are bonded by an adhesive or similar material, thereby forming a laminated structure. The pressure chamber 112 and the ink channel 113 comprise a cavity in first structure member 116. In general, a plurality of sets, each set comprising a the pressure chamber 112, an ink channel 113 and individual electrodes 120 are formed and disposed such that each set is separated from the other sets. The second structure member 117 is similarly formed with a plurality of separate ink inlets 115. Third structure member 118, comprising a plurality of separate ink outlets 114, is aligned with the second structure member so that the outlets align with the pressure chambers 112. The ink is supplied through the ink inlet 115, filling the ink channel 113 and the pressure chamber 112 with ink.

The diaphragm 119 is made of a conductive material and is in conductive communication with the electrodes 120au, 120bu, and so on mounted on the bonded surface of the piezoelectric member 111. Thus, if an electric voltage is applied between the diaphragm 119 and the individual electrodes 120*a*, 120*b*, and so on, diaphragm 119 conducts current and deforms, also deforming the section of the piezoelectric member 111 laminated to the diaphragm 119. Thus a selected section of piezoelectric member 111 and diaphragm 119 corresponding to each set of electrodes 120*a*, 120*b*, and so on can be deformed by selecting the set of electrodes to be energized with an electric voltage. The deformation pressurizes ink in the pressure chamber 112 underlying energized electrode 120*a*, for example, and the amount of ink responsive to the pressure is ejected from the ink outlet 114. The amount of deformation depends on the electric voltage applied to the piezoelectric member 111. Therefore, by controlling the magnitude of the electric voltage and the location at which the electric voltage is applied, the amount and location of the ink ejection can be arbitrarily changed.

The conventional thermal ink jet printhead, in general, is inferior to the piezoelectric method in terms of the response speed. On the other hand, a drawback of piezoelectric ink jet printheads is that the displacement of the piezoelectric member and the diaphragm is restricted by the thickness of the piezoelectric member. If the piezoelectric member is too thick, insufficient displacement may be provided due to the rigidity of the piezoelectric member itself. If the area of the piezoelectric member is increased to enlarge the displacement, the size of the ink jet printhead increases, making it difficult to achieve higher nozzle densities (the number of nozzles within a particular area). As a result, material cost increases. When the area of the piezoelectric member can not be increased, a higher driving voltage is required for a sufficient deformation.

Piezoelectric members with thickness of about 20 $\mu$m have become available now through thick film forming and the integrated firing techniques, however, a higher nozzle density is still required for improved print quality. In order to reduce the area of the piezoelectric member to achieve a higher nozzle density, reduction of the piezoelectric member thickness is essential. However, conventional methods have limitations in this regard.

A cavity is typically provided within structures made of stainless steel or the like in order to form the ink channel, so for precise and complex ink channels, an increased number of layers may be required. Adhesive used on the bonded section is exposed to fluid for a long time, and therefore, reliability of the adhesive bond has always required close attention.

SUMMARY OF THE INVENTION

A fluid ejection device of the present invention includes at least one pressure chamber divided independently from other pressure chambers, an ink channel communicating with the pressure chamber, an ink outlet communicating with the pressure chamber, and a pressure generating section having a laminated body made of a piezoelectric material and an elastic body, the pressure generating section covering one face of the chamber. The pressure chamber, the ink channel and the ink outlet are defined by a structure comprising at least one planar silicon substrate bonded to at least one planar glass substrate.

A process for manufacturing the fluid ejection device of the present invention comprises the steps of: forming a through-hole for the pressure chamber and a through-hole for the ink inlet on a first substrate; bonding the first substrate to a second substrate; bonding the second substrate to a third substrate; and forming a pressure generating section comprising a laminated body including piezoelectric material and an elastic material such that the pressure generating section covering the through-hole for the pressure chamber with the pressure-generating section. The piezoelectric material may be a thin film material of PZT deposited by sputtering. The silicon substrates may be processed by reactive ion etching (RIE) and the glass substrates may processed by sand-blasting. The substrates may be directly bonded to one another by processing the surfaces and heating without the use of resin or other adhesives.

The configuration discussed above provides a thinner piezoelectric member, allowing a higher nozzle density. A plurality of silicon and glass substrates may be simultaneously finely processed by etching and sand-blasting, thereby improving processing precision and reducing the number of production steps. The silicon and glass substrates can be directly bonded, increasing the long-term reliability against inflow of fluid. Furthermore, multiple substrates can be bonded at one time, contributing to streamlining of the production processes.

DESCRIPTION OF THE PREFERRED EMBODIMENTS

First Exemplary Embodiment

Figure 1:
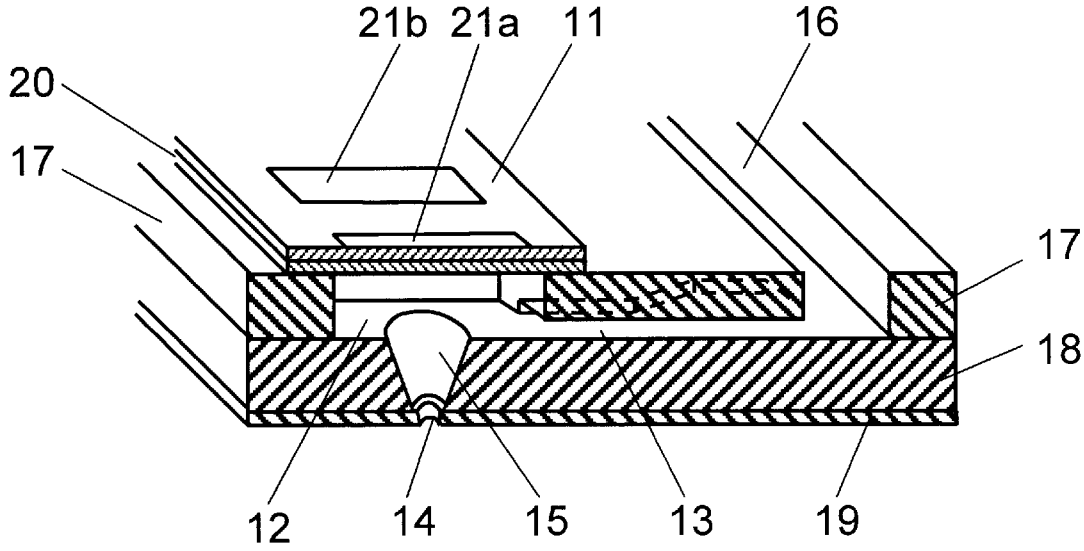
FIG. 1 shows a sectional perspective view of a fluid ejection device in accordance with the first exemplary embodiment of the present invention.

FIG. 1 is a perspective cross sectional view illustrating an example of a fluid ejection device comprising silicon, glass and piezoelectric thin films.

As shown in FIG. 1, a fluid ejection device in accordance with the first exemplary embodiment comprises: a piezoelectric thin film 11, a pressure chamber 12, an ink channel 13, an ink outlet 14, a through-hole 15, an ink inlet 16, a first silicon substrate 17, a glass substrate 18, a second silicon substrate 19, an elastic body 20 and individual electrodes 21 (21*a* and 21*b* shown in FIG. 1). More specifically, the fluid ejection device of this embodiment comprises a laminated body comprising first silicon substrate 17, the glass substrate 18 and the second silicon substrate 19, the piezoelectric thin film 11, the elastic body 20, and the individual electrodes 21 mounted on the piezoelectric thin film 11.

First silicon substrate 17 is provided with such elements as a plurality of pressure chambers 12, each formed as an individual through-section at the position corresponding to the individual electrodes 21, a plurality of ink channels 13, each having a depth that is about half the thickness of silicon substrate 17 and in communication with pressure chamber 12, and a plurality of ink inlets 16, each comprising a through-section communicating with one of the ink channels 13. The cross-sectional area of the ink channel 13 expands outwardly as it goes away from the pressure chamber 12 (illustrated as dotted lines in FIG. 1). FIG. 1 shows a single set comprising one of the individual electrodes 21*a*, the pressure chamber 12, the ink outlet 16 and so on. A fluid ejection device generally has a plurality of sets constructed in a similar manner including the individual electrodes, the pressure chamber and the ink outlet. FIG. 1 also shows one of the individual electrodes 21*b* from a second set.

Silicon substrate 17 and the glass substrate 18 are bonded together such that pressure chamber 12 and the ink channel 13 are sealed except for through-hole 15 aligned with pressure chamber 12. Centered with the through-hole 15 is ink outlet 14A having an area smaller than the opening portion of the through-hole 15 on the second silicon substrate 19. The glass substrate 18 and the second silicon substrate 19 are bonded together. The piezoelectric thin film 11 is bonded to elastic body 20, which is bonded over pressure chamber 12 opposite the through-hole 15. The piezoelectric thin film 11 has the individual electrode 21*a* formed on front surface thereof, and another individual electrode on the back surface (not shown in the drawing).

The fluid flows in from the ink inlet 16, fills the ink channel 13, pressure chamber 12 and the through-hole 15, and is held at ink outlet 14. When an electric voltage is applied between the elastic body 20 and the individual electrodes 21*a*, 21*b*, and so on of the piezoelectric thin film 11, the laminated body of the piezoelectric thin film 11 and the elastic body 20 are deformed. Because elastic body 20 is made of a conducive material, it conducts current from electrode 21 a mounted on the front side of piezoelectric thin film 11 to the electrode mounted on the back face of the piezoelectric thin film, and deformation occurs when the voltage is applied between the elastic body 20 and individual electrodes 21. The exact position of the laminated body to be deformed can be changed freely by selecting the individual electrode 21 to be energized with voltage. The deformation of the laminated body comprising the piezoelectric thin film 11 and the elastic body 20 pressurizes the fluid in the pressure chamber 12, and the fluid is ejected from the ink outlet 14 in a volume responsive to the strength of the pressure.

In general, a piezoelectric thin film 11 is made of a material with a high piezoelectric constant, such as a lead zirconium titanium oxide (also known as PZT), for example $PbZr_xTi_{1-x}O_3$ or another PZT related material. A thin film made of such material is manufactured,under certain conditions known in the art, by depositing a film on a magnesium oxide (MgO) substrate for the piezoelectric thin film by sputtering. The MgO substrate is then etched away in phosphate or in a similar chemical such that the piezoelectric thin film 11 remains.

The shape of the ink outlet 14 affects ejection speed and the area of the ejected fluid, and thus is a key element determining the printing performance of an ink jet printer. A smaller opening area of the ink outlet 14 enables finer printing, however, an excessive difference in the area of the pressure chamber as compared to the ink outlet may result in a large pressure loss across the ink outlet, thus negatively impacting the desirable ejection. This loss can be reduced when the glass substrate 18 is provided with a through-hole 15 having a cross-sectional area that tapers from the pressure chamber toward the ink outlet. This construction comprising ink outlet 14 on second silicon substrate 19 plus tapered through-hole 15 on glass substrate 18 makes the shape of the ink outlet more controllable than a construction having a tapered hole alone, resulting in the ink outlet 14 with finer and more uniform shape.

When pressure is applied to pressure chamber 12, the pressure is not kept within the ink outlet 14 but is also transmitted to the ink channel 13, which may trigger a back flow of the fluid. To solve this problem, the ink channel 13 is shaped in a manner that its opening space (illustrated as dotted lines in FIG. 1) tapers narrower toward the pressure chamber 12, thereby increasing resistance against back flow, and improving ink ejection. The same effect can be obtained by providing a narrower section in the ink channel 13. When the area of the narrower section in the ink channel 13 is about 0.5 to 1.5 times as large as the area of the ink outlet 14, good ejection is secured by preventing the back flow.

A piezoelectric thin film 11 of several $\mu$m in thickness can easily be obtained using the sputtering method, such film being thinner than conventional films. When the piezoelectric thin film 11 is thinner, its own rigidity is reduced, thus a larger deformation is more easily obtained. When the magnitude of deformation is the same, the strain is smaller on the thinner film, and therefore reliability for repeated loading can be improved. As it has been described, the thinner piezoelectric material contributes to a reduced size actuator and its surrounding area, including the area of the ink outlet 14, contributing to a higher nozzle density and in turn, improved print quality.

If the piezoelectric thin film 11 is too thin, a poor driving force may result. Manufacturing thicker material using the thin film technique is generally inefficient because it requires a longer sputtering time. Therefore, it is preferable for the thickness of a piezoelectric thin film to be less than about 7 $\mu$m to provide a secure driving force and a reasonable film manufacturing cost. Because the piezoelectric thin film 11 generally cannot deform by itself, it is preferably laminated to elastic body 20. In order for the elastic body 20 to be elastic while maintaining conductivity, stainless steel or another metallic material is preferably used. The thickness and the rigidity of each layer affect the position of the neutral plane during deformation. The further the neutral plane moves away from the boundary surface, the more the stress generated at the boundary surface increases, increasing the risk of delamination. Conversely, when the neutral plane is formed inside the piezoelectric member, driving efficiency declines. Therefore, in order to secure the neutral point in the vicinity of the boundary surface, the thickness of the elastic body made of metallic material is preferably the same or smaller than the thickness of the piezoelectric member.

The piezoelectric material needs to deform only over each pressure chamber, therefore, the piezoelectric material is not needed in the partitions of adjacent pressure chambers. Rather, when the piezoelectric material is separated between each pressure chamber, interference between adjacent piezoelectric members and stress imposed on the piezoelectric material during the bonding process and during actual deformation can be avoided, so that cracking in the piezoelectric material is minimized.

FIG. 2 shows sectional views illustrating an example of the production method for dividing the piezoelectric material.

Figure 2A:
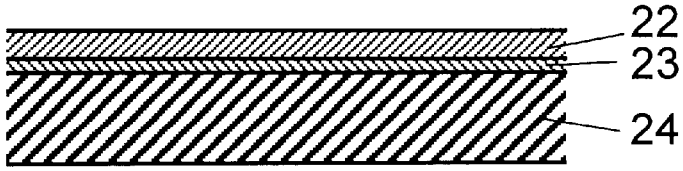
FIGS. 2A–2E show a manufacturing process of a piezoelectric thin film of the first exemplary embodiment as set forth in FIG. 1.
Figure 2B:
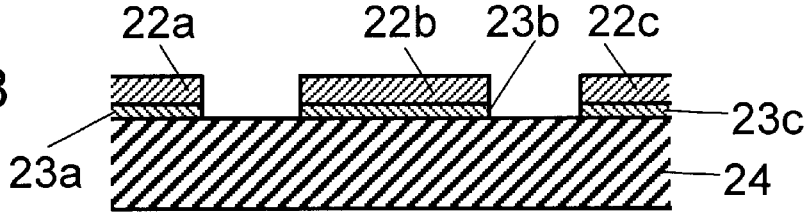

First, as shown in FIG. 2A, a material for the individual electrode 23 and a piezoelectric thin film 22 are deposited on a MgO substrate 24 by the sputtering method. Second, the material for the individual electrode 23 and the piezoelectric thin film 22 are selectively etched away and divided into individual electrodes 23*a*, 23*b* and 23*c*, and piezoelectric thin films 22*a*, 22*b* and 22*c* respectively (FIG. 2B).

Figure 2C:
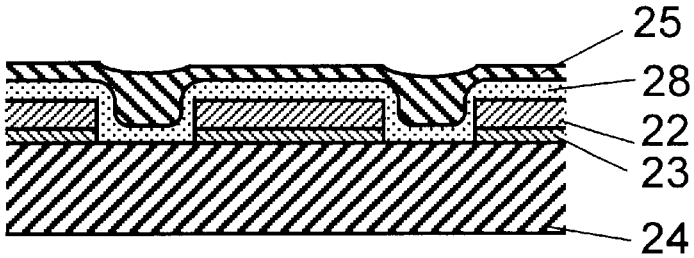
Figure 2D:
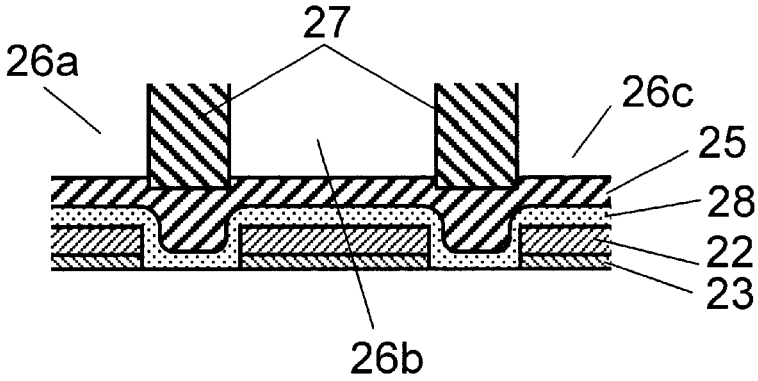

Third, an elastic body 28 made of chromium or another metallic material is formed by the sputtering method or the like. The elastic body 28 not only supports the piezoelectric thin film but also serves as the electrodes on the other side of the piezoelectric film. Then a resin material 25 such as polyimide is coated thereon (FIG. 2C). Then, a silicon substrate 27 is bonded to the dividing portion or the portion where the material for the individual electrode 23 and the piezoelectric thin film 22 are etched away selectively, such that only pressure chambers 26*a*, 26*b* and 26*c* contact the piezoelectric thin films 22*a*, 22*b* and 22*c*. Finally, the MgO substrate for the piezoelectric thin film is immersed in a phosphate solution and removed (FIG. 2D).

Figure 2E:
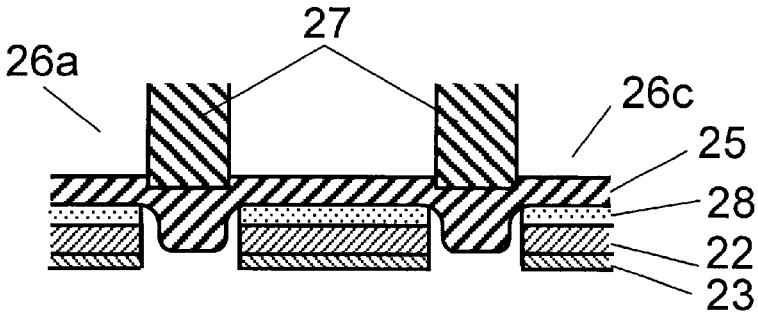

Finally a well known process is performed, namely, portions of the elastic body 28 around each individual electrode 23 are etched away in order to electrically separate each individual electrode 23 from the elastic body 28. This is performed by coating the whole surface except for the portions around each individual electrode 23 with photoresist and immersing the entire body in an etching solution (FIG. 2E). It is noted that, although the portions of the elastic body around each individual electrode 23 are removed, entire remaining part of the elastic body 28 is still kept continuous.

By the process described above, the dividing portions are strengthened by the resin material 25. Moreover, since the rigidity of the resin material 25 is low, it does not significantly affect the driving process.

The construction discussed above provides a fluid ejection device that ejects fluid from an arbitrarily selected ink outlet in a plane of a substrate.

Following is an example of a manufacturing process. FIGS. 3A–3E, FIGS. 4A–4E and FIGS. 5A–5D show sectional views illustrating steps in the manufacturing process of the fluid ejection device of the present invention.

Figure 3A:
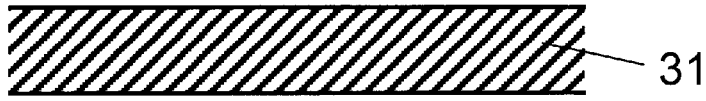
FIGS. 3A–3E show a manufacturing process of a silicon substrate of the first exemplary embodiment as set forth in FIG. 1.
Figure 3B:
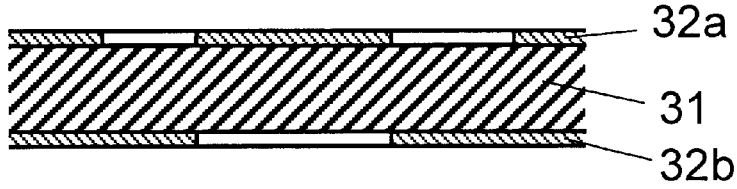

FIGS. 3A–3E show an example of the processing of the first silicon substrate 31. Both sides of a first silicon substrate 31 as shown in FIG. 3A are coated with resists 32*a* and 32*b*, and the patterning is carried out by the photolithography technique (FIG. 3B). In this process, patterns are formed corresponding to the position and shape of each pressure chamber 34 and ink channel 33.

Figure 3C:
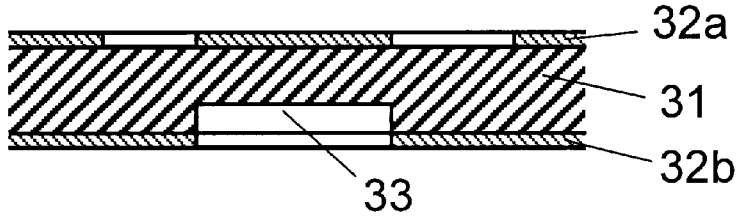
Figure 3D:
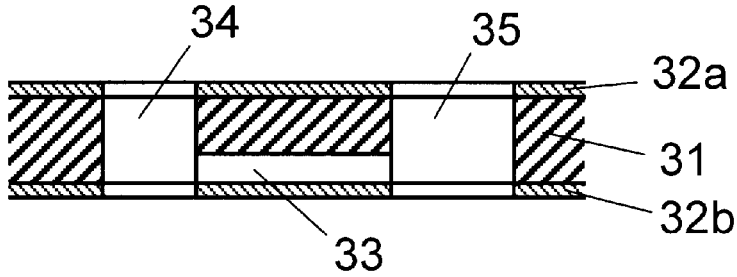
Figure 3E:
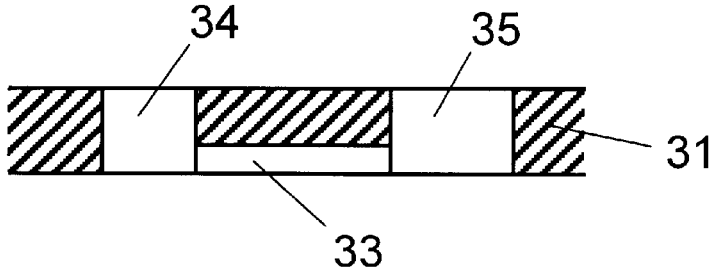

Next, silicon is etched from the side coated with the resist 32*b*, such as by reactive ion etching (RIE). The etching stops at a predetermined depth in the thickness of the substrate so that an opening is formed on only one side, forming ink channel 33 (FIG. 3C). Then, etching is performed from the resist 32*a* side forming a through-section communicating with the ink channel 33. By this process, a pressure chamber 34 and an ink inlet 35 are formed (FIG. 3D). Finally, the resists 32*a* and 32*b* are removed to conclude the manufacturing process of the first silicon substrate 31 (FIG. 3E).

FIGS. 4A–4E show an example of a manufacturing process of a glass substrate 41 and a second silicon substrate 44.

Figure 4A:
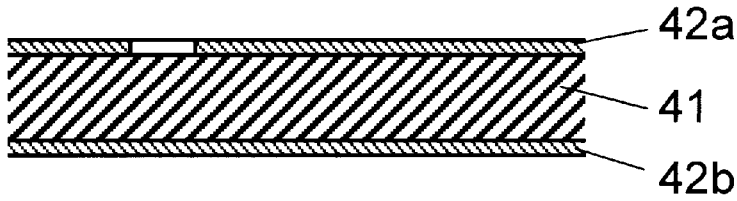
FIGS. 4A–4E show a manufacturing process of an ink outlet of the first exemplary embodiment as set forth in FIG. 1.
Figure 4B:
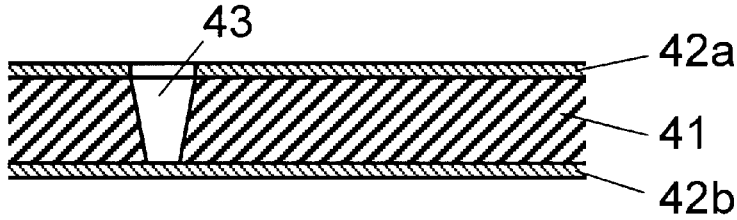

First, both sides of the glass substrate 41 are coated with resists 42*a* and 42*b* Then, a pattern is formed only on the resist 42*a* side at a place corresponding to the pressure chamber (FIG. 4A). Next, abrasive grains are sprayed by the sand-blasting method from the resist 42*a* side, forming a through-hole 43 in glass substrate 41. (FIG. 4B). This process forms a through-hole 43 that tapers from the side being sprayed with the abrasive grains toward the other side. The resist 42*b* protects the other face from damage caused by the abrasive grains.

Figure 4C:
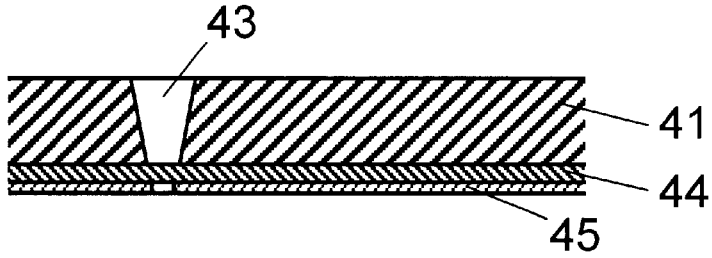
Figure 4D:
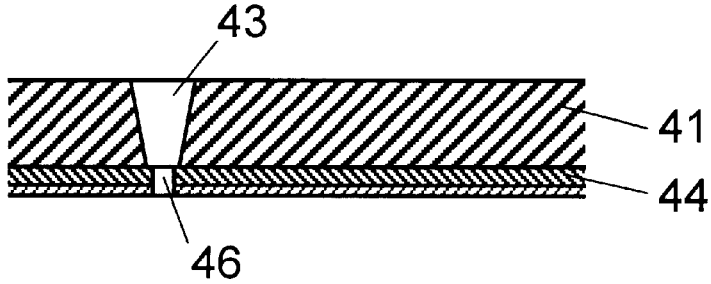

Then, after the resists 42*a* and 42*b* are removed, the second silicon substrate 44 and the glass substrate 41 are directly bonded by a direct bonding technique. Patterning of a resist 45 coated on the second silicon substrate 44 is processed so as to form ink outlets 46 in positions corresponding to each pressure chamber (FIG. 4C).

The direct bonding technique is a method to bond substrates by washing the substrates and heating them without using any inclusions such as resin or applying a high electric voltage, as is the case with the anodic bonding method. In the direct bonding technique, for example, glass and silicon with a smooth surface are washed in peroxomonosulfuric acid, peroxodisulfuric or the like, and stacked after drying.

Figure 4E:
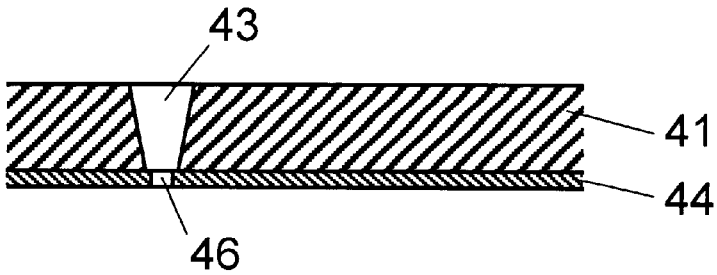

When the substrates are pressed, some bonding is gained, and the stacked body is heated at several hundred degrees Celsius to increase bonding strength. This method can lead to an extremely strong bond when optimum substrate materials are used and optimum washing and heating conditions are provided. For example, one delamination test revealed that in the bonding of glass substrates, bonding strength was so high that, in some failure modes, damage was caused not on the bonded surfaces but inside the substrate itself. The direct bonding technique provides high reliability free from degradation in the bonded layers occurring over time or as a result of contact with fluid as is the case with the bonding methods using resin or similar material. Furthermore, the manufacturing process is very simple, requiring only washing and heating processes. Following the bonding process, the second silicon substrate 44 is etched, such as by RIE (FIG. 4D), and the resist 45 is removed to complete the process (FIG. 4E).

The method illustrated in FIGS. 4A–4E and described above allows for easy alignment of both through-holes. Moreover, the substrates can be handled more easily because the bonding process increases the total thickness of the stacked substrates. As a result, a thinner second substrate can be used, and a through-hole for the ink outlet on the second silicon substrate, which has a strong influence on the ejection performance, can be formed precisely and uniformly.

FIGS. 5A–5D show sectional views illustrating the bonding process of a laminated body comprising a processed first silicon substrate 56, a glass substrate 57 and a second silicon substrate 58, and a piezoelectric thin film 59 (including an elastic body).

Figure 5A:
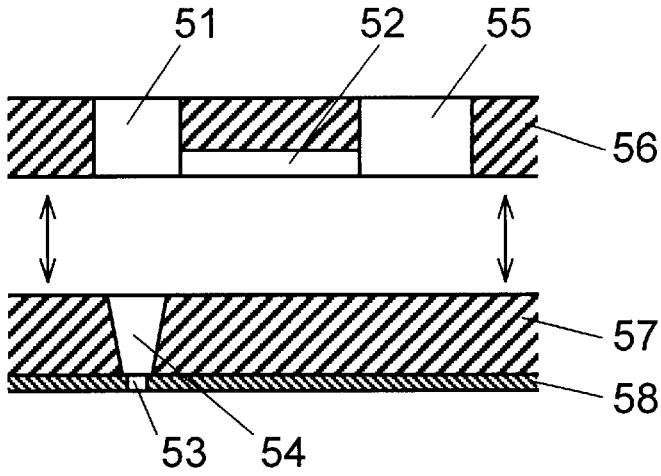
FIGS. 5A–5D show a manufacturing process of the fluid ejection device of the first exemplary embodiment as set forth in FIG. 1.
Figure 5B:
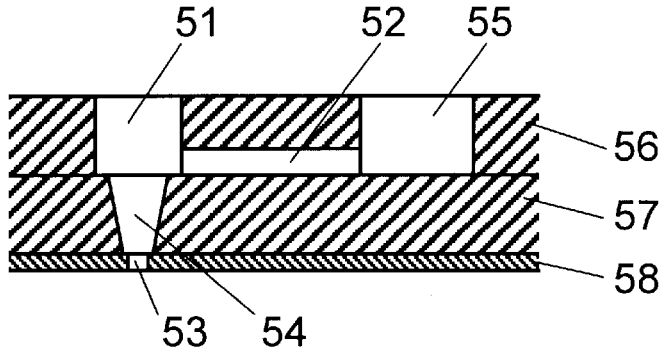
Figure 5C:
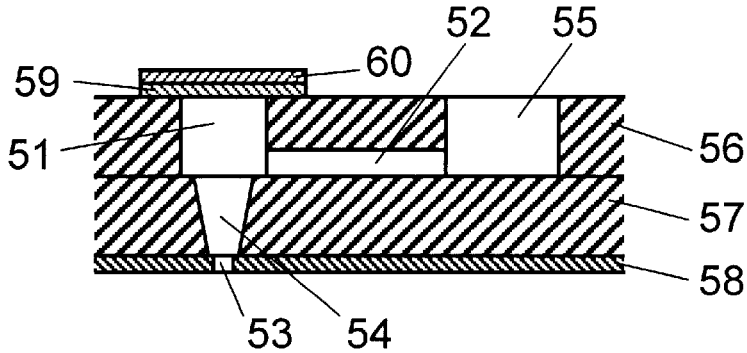
Figure 5D:
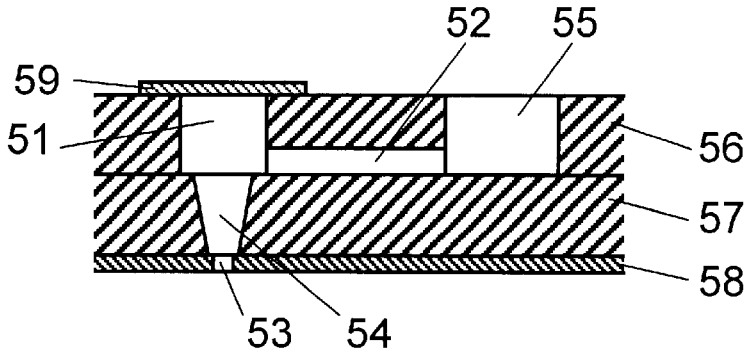

First silicon substrate 56 processed in a manner illustrated in FIGS. 3A–3E and the laminated body of the second silicon substrate 58 and the glass substrate 57 processed in a manner illustrated in FIGS. 4A–4E (FIG. 5A) are bonded by the direct bonding method described above (FIG. 5B). Before this process, pressure chamber 51 and through-hole 54 are aligned. Next, the piezoelectric thin film 59 (including an elastic body) formed on a substrate 60 made of MgO or the like is bonded onto the top of the pressure chamber 51 (FIG. SC). Finally, the MgO substrate 60 is removed to complete the process (FIG. 5D). For a substrate 60 made of MgO, the substrate can be removed by immersing it in a phosphate solution or the like.

By the aforementioned method, a micro-fabrication technique can be adopted to realize high-precision and high-efficiency processing. Moreover, the bonding process is simple and the end product is highly reliable. When sand-blasting is used, fragile material such as glass can be processed rapidly with the through-hole automatically given an even tapering shape suitable for ejecting the ink. The technique described above has a potential for processing a variety of shapes by pattern designing and is applicable to a wide range of designs.

The ink channel formation method described above for the first silicon substrate 56 forms a groove with a predetermined depth in the direction of the thickness of the substrate, however, an alternative method for forming a through-section as the ink channel is also available. The method is described below.

FIGS. 6A–6F are sectional views illustrating processing and assembly methods of a first silicon substrate 61.

Figure 6A:
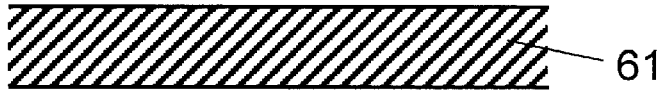
FIGS. 6A–6F show an alternative manufacturing process of a silicon substrate.
Figure 6B:
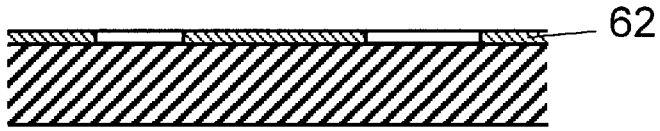
Figure 6C:
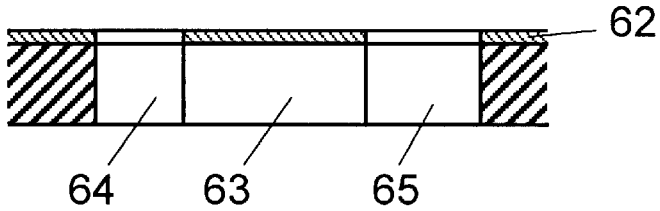
Figure 6D:
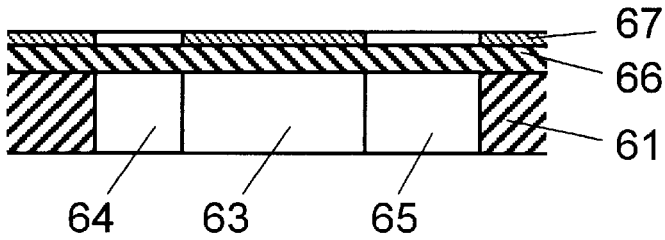
Figure 6E:
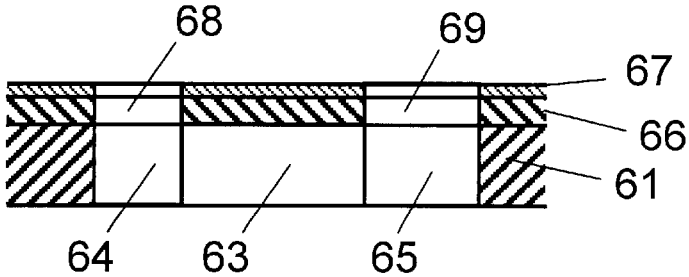
Figure 6F:
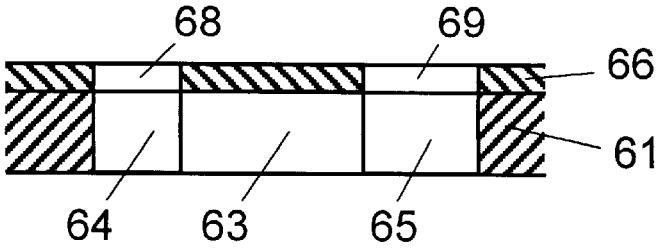

The first silicon substrate 61 is coated with a first resist 62, and the patterning is carried out in predetermined positions (FIG. 6B) so as to allow an ink channel 63, a pressure chamber 64 and an ink inlet 65 to be processed. Next, the ink channel 63, the pressure chamber 64 and the ink inlet 65 are formed by RIE or a similar technique such that each of the three elements mentioned above forms a through-section extending through the thickness of the silicon substrate 61 (FIG. 6C). After the first resist 62 is removed, the first silicon substrate 61 is directly bonded to a sealing glass substrate 66, coated with a second resist 67, and patterned (FIG. 6D). Following this process, portions corresponding to the pressure chamber 64 and the ink inlet 65 are processed by sand-blasting, forming a first glass through-hole 68 and a second glass through-hole 69 respectively communicating with the pressure chamber 64 and the ink inlet 65 (FIG. 6E). If the first silicon substrate 61 has to be protected from the sand-blasting, it can be coated with resists on both sides. Alternatively, processing by sand-blasting can be stopped immediately before penetration, and the glass through-hole formed by etching the remaining glass by ammonium fluoride or the like. Finally, the second resist 67 is removed to complete the process (FIG. 6F).

Figure 12:
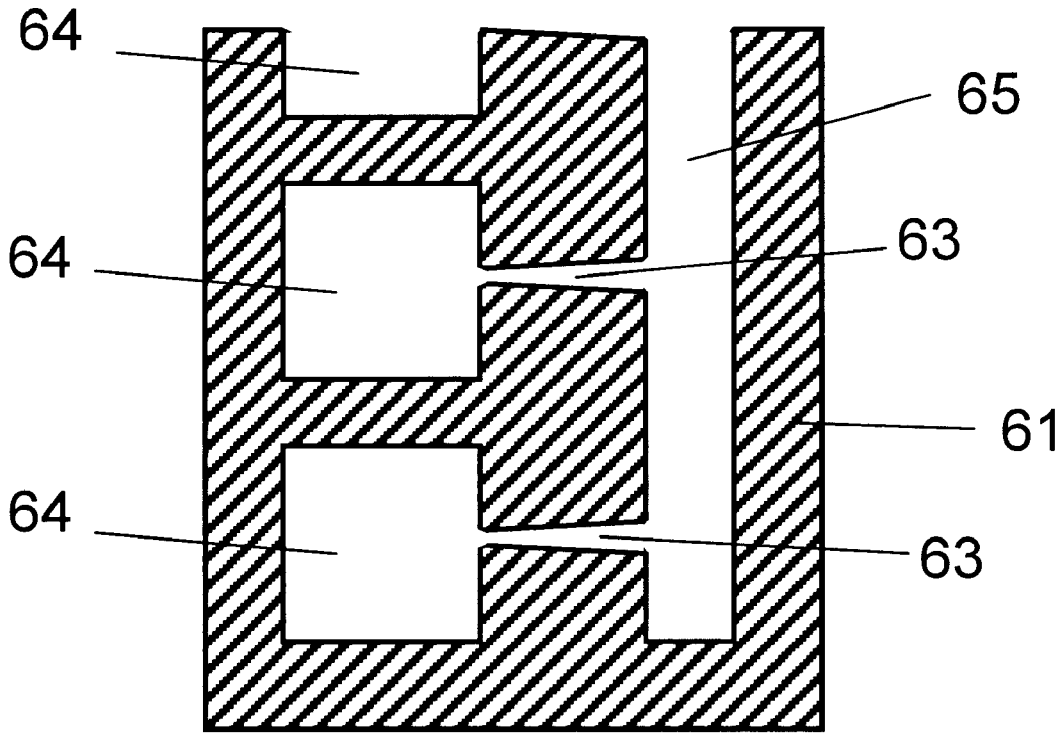
FIG. 12 shows a plan view of the processed silicon substrate in accordance with the first exemplary embodiment of the present invention.

FIG. 12 shows a schematic view illustrating the shape of the first silicon substrate already processed by the aforementioned method, as viewed from the surface of the substrate. The ink channel 63, which communicates with the pressure chamber 64 and ink inlet 65, is shaped such that it tapers toward the pressure chamber, as is illustrated. This taper increases resistance to back flow of fluid as described previously.

With the aforementioned method, the processing of the first silicon substrate 61 is efficient since it does not require additional processing, as set forth in FIGS. 3A–3E. In addition, because ink channel 63 is determined by the thickness of the first silicon substrate 61, it can be shaped evenly. Moreover, the cavity in the pressure chamber can be expanded by the thickness of the sealing glass substrate 66 so that more fluid can be injected into the pressure chamber, further optimizing ejection conditions. If a silicon substrate is too thick, the formation of a through-hole may be difficult. Thus, this method allows formation of a larger pressure chamber without the difficulties inherent in forming through-holes in thick silicon. One end of the ink channel 63 is sealed in the process described in FIG. 6, and therefore, bonding to other elements is also possible in the same manner as the other examples shown in FIG. 5. In FIG. 6, the glass substrate was processed after being bonded directly to the silicon substrate. This method is also applicable to the other processes described herein.

Figure 13A:
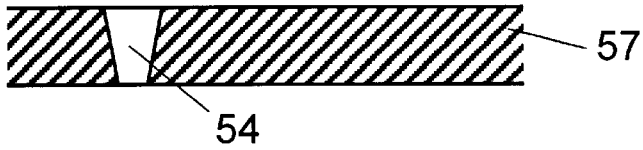
FIGS. 13A–13E show a manufacturing process chart illustrating processing steps of the silicon and glass substrates.
Figure 13B:
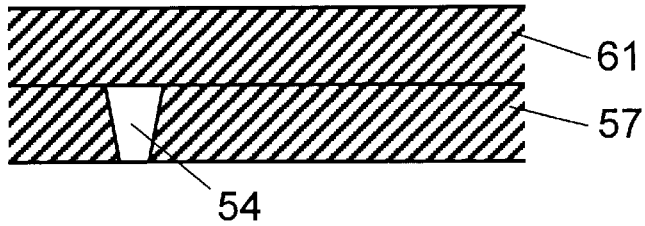
Figure 13C:
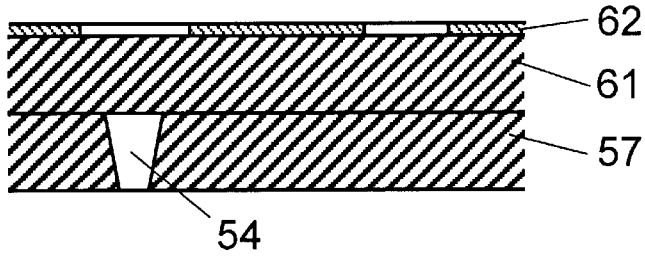
Figure 13D:
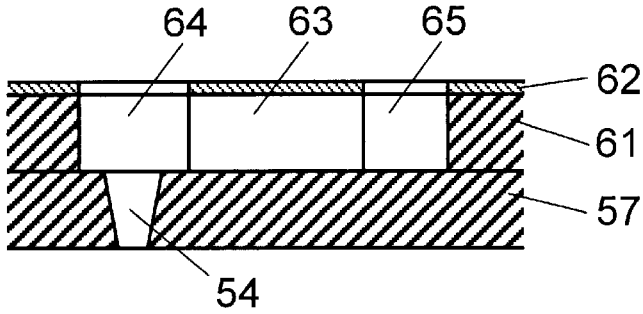
Figure 13E:
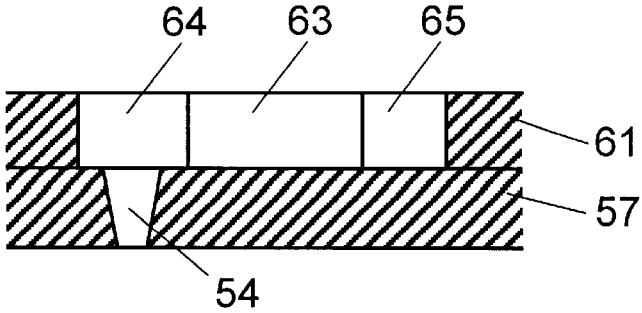

Another alternative method for forming an ink channel is given below as an example, referring to FIG. 13. The glass substrate 57 already having a through-hole 54, such as formed by sand-blasting (FIG. 13A), is directly bonded to the first silicon substrate 61 (FIG. 13B). Next, the first silicon substrate 61 is coated with the resist 62 and is patterned (FIG. 13C). The resist is patterned as shown in FIG. 12. Then, through-holes 64, 65 and a through-hole for ink channel 63 corresponding to the pressure chamber and the ink inlet are processed at the same time (FIG. 13D) and the resist 62 is removed to complete the process (FIG. 13E).

With this method, the total thickness of the substrate becomes larger, thereby intensifying its strength. As a result, damages occurring during the processing can be minimized. In addition, the direct bonding process, which is easily influenced by dust and dirt, is conducted first. Therefore, concerns over the influence of dust and dirt can be eliminated in subsequent processes. Since the substrates are bonded directly, erosion into the boundary surfaces during etching is not a significant concern, unlike bonding using resin or other similar material. Furthermore, because the processing on the first silicon substrate is conducted after the bonding of the glass substrate and the first silicon substrate, the through-holes may be easily aligned. Increasing the effective thickness of the substrate by lamination reduces cracking. In addition, because etching on the first silicon substrate is stopped at the bonding plane with the glass substrate, the shape of the grooves can be uniformly controlled, enabling formation of highly uniform channels.

Figure 14A:
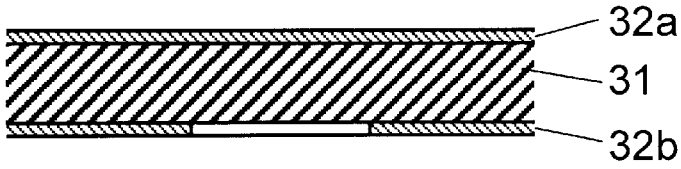
FIGS. 14A–14E show a manufacturing process chart illustrating another processing steps of the silicon and glass substrates.
Figure 14B:
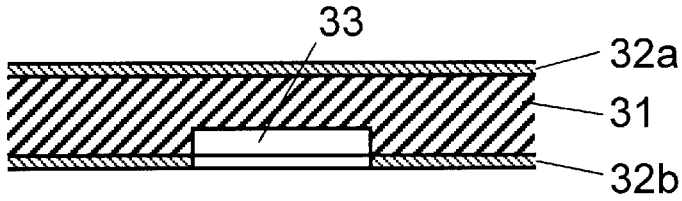
Figure 14C:
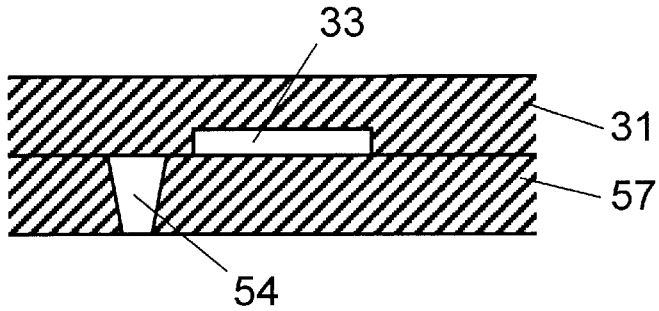
Figure 14D:
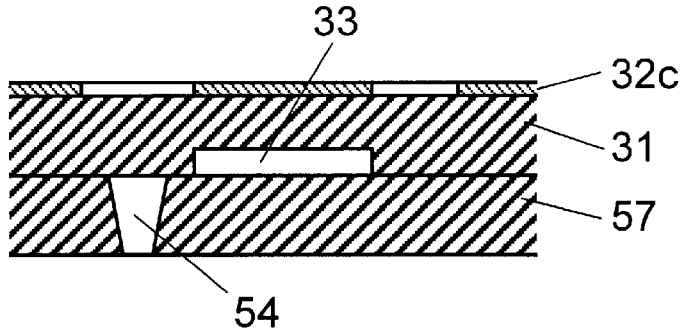
Figure 14E:
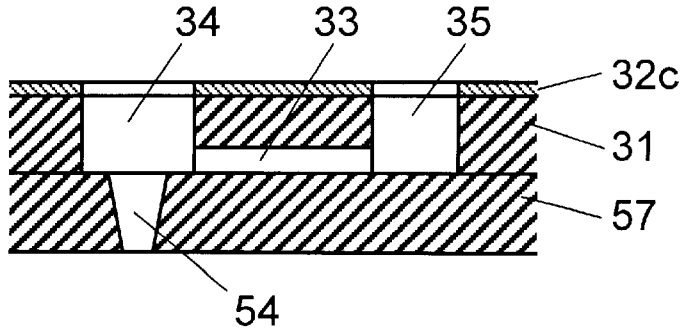

Referring now to FIGS. 14A–14E, the following processing methods are applicable to the other methods of this embodiment described earlier (FIG. 3A–FIG. 5D). The first silicon substrate 31 is coated with the resist 32*a* and 32*b*, and patterned (FIG. 14A). The silicon substrate 31 is processed, such as by RIE, up to the certain depth in the direction of the thickness to form the ink channel 33 (FIG. 14B). Next, the first silicon substrate 31 is bonded directly to the glass substrate 57 on which the through-hole 54 has already been formed, such as by sand-blasting (FIG. 14C). The first silicon substrate 31 is coated with a resist 32*c* and is patterned (FIG. 14D). Then, through-holes 34 and 35 corresponding to the pressure chamber and the ink inlet are processed on the first silicon substrate 31, such as by RIE (FIG. 14E). This method can facilitate precise positioning and control of the size of the through-hole 34 on the first silicon substrate 31 because it can be conducted by referring to the through-hole 54 of the glass substrate 57. Etching speeds are different between the bonded surfaces of the first silicon substrate 31 and the glass substrate 57 because the characteristics of these materials are different. As a result, the processing of the through-holes 34 and 35 precisely stopped, thereby forming the through-holes uniformly.

The same method can be applied to the bonding process of the glass substrate 71 and the second silicon substrate 72 as shown in FIGS. 7A–7D. In this case as well, a through-hole can be formed after bonding them directly.

In addition, by making a second silicon substrate 72 thinner by lapping, a finer and more precise processing can be expected.

FIGS. 7A–7D show sectional views illustrating an example of the process for thinning the second silicon substrate 72 by lapping.

Figure 7A:
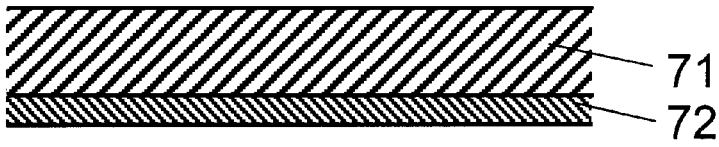
FIGS. 7A–7D show an alternative manufacturing process of an ink outlet.
Figure 7B:
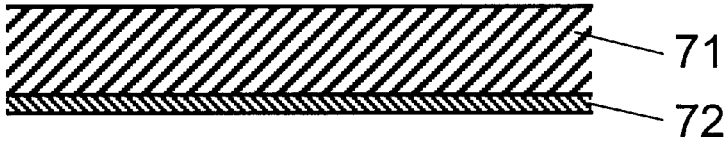
Figure 7C:
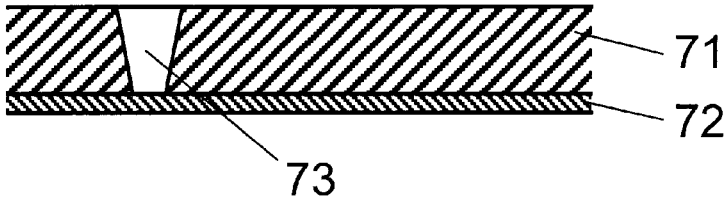
Figure 7D:
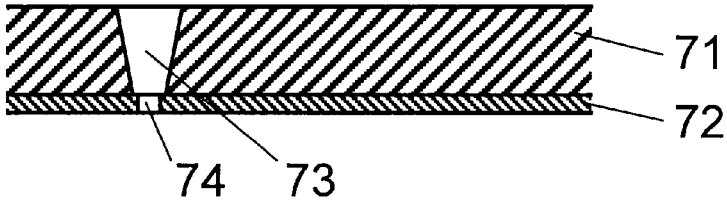

A glass substrate 71 and a second silicon substrate 72 are directly bonded as set forth in the foregoing example (FIG. 7A). After this process, the second silicon substrate 72 is lapped to reduce its thickness (FIG. 7B) and subsequently, a through-hole 73 and an ink outlet 74 are formed, such as by sand-blasting and RIE respectively (FIGS. 7C and 7D). If the second silicon substrate 72 is thick, processing takes time and tends to be uneven, which makes difficult to form uniform holes. Moreover, a very small and deep through-hole is difficult to form.

Therefore, the second silicon substrate 72 is preferably thin. However, in the case of a single silicon plate, there is a limitation in terms of the handling during the manufacturing process and the yield of the processing. The direct bonding with the glass substrate increases rigidity, and thus the substrate can be lapped with ease. After lapping, the silicon substrate can be sent as is to the next process. In order to provide a fluid ejection device with a higher ejection density, it is desirable to provide the diameter of the ink outlet as narrow as less than tens of $\mu$m. If the silicon plate is also thinned to around 50 $\mu$m or less, more compact ink outlets, with a high ink outlet density and uniform shape can be formed. Since the through-holes on the glass substrate and the second silicon substrate are processed after the substrates are bonded, there is no need for alignment prior to the bonding step. Moreover, as the substrates are bonded prior to the processing, there is little risk of damage on the bonded surfaces during processing, or of dirt negatively effecting a good bond.

If there is no problem with the lapping step, the direct bonding and, lapping are carried out after a through-hole is formed in the glass substrate. This method can also produce a similar effect when the first silicon substrate is excessively thick.

The through-hole processed by sand-blasting has a shape tapering from the opening exposed to the spraying of the abrasive grains toward the opposite end. Therefore, although it is slightly affected by the size of the abrasive grains and the intensity of the spray, if the thickness of the glass plate and the diameter of the opening exposed to the spray of the abrasive grains (opening area of the resist) are uniformly set, the diameter of the opening on the opposite side is naturally set as well. Thus, by setting the thickness of the glass plate and the diameter of the opening on the spray side so that the diameter of the opening on the opposite side is slightly larger than the diameter of the ink outlet, an optimum shape is uniquely processed. To provide an ink outlet having a diameter of tens of μm or less, the glass substrate is preferably provided with a thickness of less than or equal to about 0.8 mm, in a range of thickness of about 1.2 to about 1.9 times the quantity (rg−rs), where g is the diameter of the tapered through-hole on the spray side, and rs is the diameter of the tapered through-hole on the opposite side.

Second Exemplary Embodiment

Figure 8:
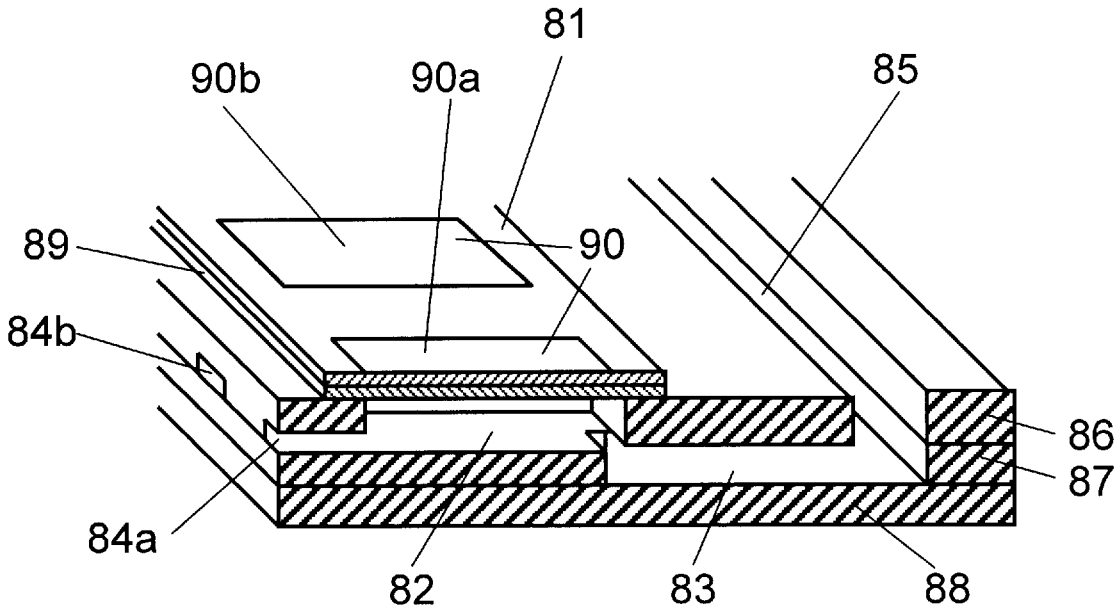
FIG. 8 shows a sectional perspective view of a fluid ejection device in accordance with the second exemplary embodiment of the present invention.

FIG. 8 shows a sectional perspective view illustrating a fluid ejection device according to the second exemplary embodiment of the present invention.

In FIG. 8, a silicon substrate 86, a first glass substrate 87 and a second glass substrate 88 are directly bonded as described in the first exemplary embodiment, forming a laminated body. The silicon substrate 86 has ink outlets 84 (84*a*, 84*b*) having openings formed on the edge of the substrate, a pressure chamber 82 penetrating and communicating with the ink outlets 84, and a through-hole which partially forms an ink inlet 85, each of them formed by RIE or similar method. The first glass substrate 87 also has a through-section. A part of the through-section communicates with the pressure chamber 82 and forms an ink channel 83 while another part partially forms the ink inlet 85.

A laminated body comprising a piezoelectric thin film 81, having individual electrodes 90(90*a*, 90*b*) mounted thereon and an elastic body 89, is bonded right on the pressure chamber 82. Each pressure chamber 82 and the ink channel 83 are separated from each other and are independent. The individual electrodes 90*a*, 90*b* are disposed to correspond to each pressure chamber 82. The second glass substrate 88 seals one end of the through-section of the first glass substrate 87, forming a part of the ink channel 83. The fluid, supplied from the ink inlet 85, fills the pressure chamber 82 via the ink channel 83, is pressurized by the displacement of the piezoelectric thin film 81 when energized by an electric voltage, and is ejected from the ink outlets 84*a* and 84*b*.

Following is the description of a manufacturing method.

FIGS. 9A–9E show sectional views illustrating the processing method of a silicon substrate.

Figure 9A:
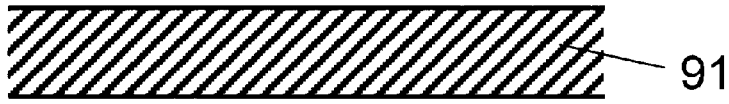
FIGS. 9A–9E show a manufacturing process of a silicon substrate of the second exemplary embodiment as set forth in FIG. 8.
Figure 9B:
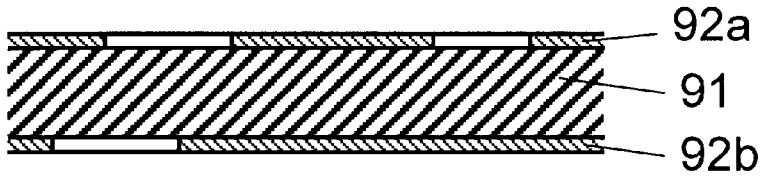
Figure 9C:
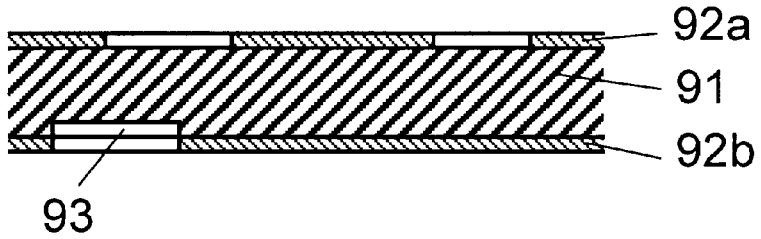
Figure 9D:
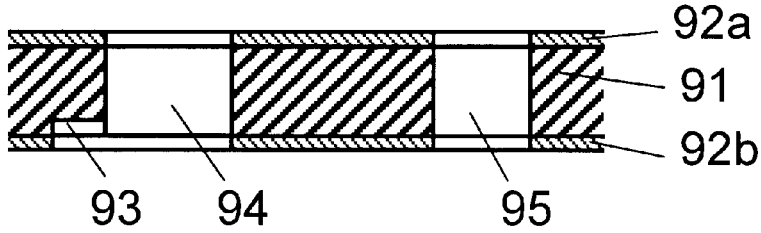
Figure 9E:
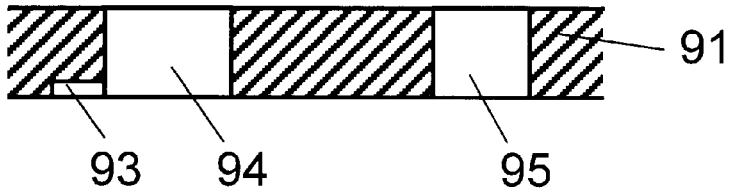

First, both faces of a silicon substrate 91 as shown in FIG. 9A are coated with resists 92*a* and 92*b*, and patterning is carried out (FIG. 9B). Next, one side of the silicon substrate 91 is shallowly etched, such as by RIE, and an ink outlet 93 is formed (FIG. 9C). Then, a through-section is formed from the other face to form a pressure chamber 94 and an ink inlet 95 such that the pressure chamber 94 partially communicates with the ink outlet 93 (FIG. 9D). Finally, the resists are removed from both sides to complete the process (FIG. 9E).

FIGS. 10A–10F show sectional views illustrating assembly method of the whole device.

Figure 10A:
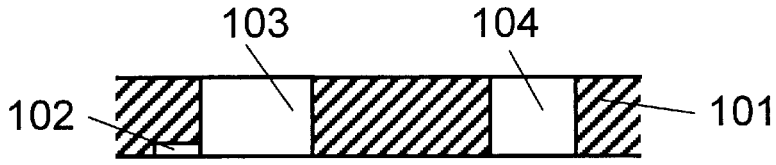
FIGS. 10A–10F show a manufacturing process of the fluid ejection device of the second exemplary embodiment as set forth in FIG. 8.
Figure 10B:
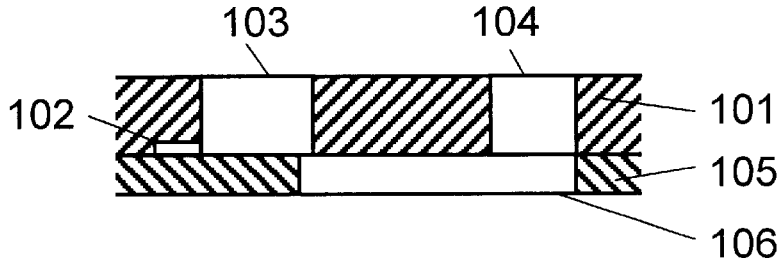
Figure 10C:
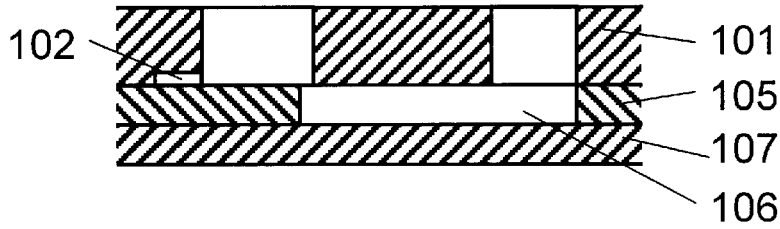
Figure 10D:
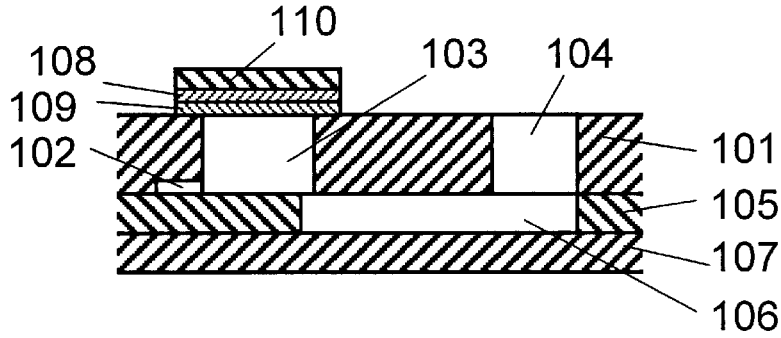

A first glass substrate 105 of which a through-section is already processed by the sand-blasting with an ink channel 106 being formed therein, is directly bonded to a silicon substrate 101 (FIG. 10B) which is already processed by the method shown in FIGS. 9A–9E (FIG. 10A). In this bonding step, the ink channel 106 is set to communicate with a pressure chamber 103 and an ink inlet 104, and the direct bonding is carried out on the face having the ink outlet 102. Next, a second glass substrate 107 and the first glass substrate 105 are directly bonded to seal one side of the ink channel 106 (FIG. 10C).

Figure 10E:
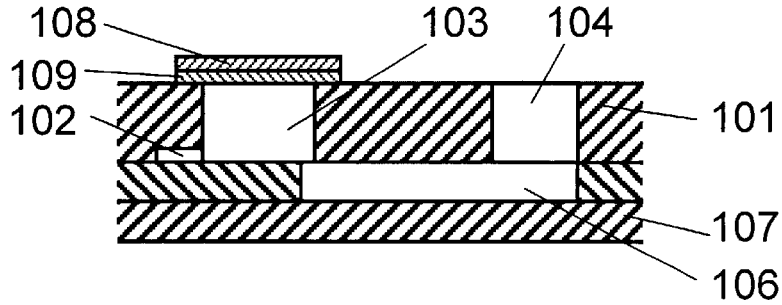
Figure 10F:
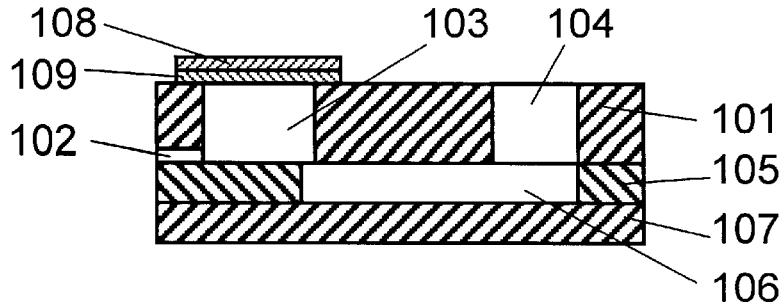
Figure 11:
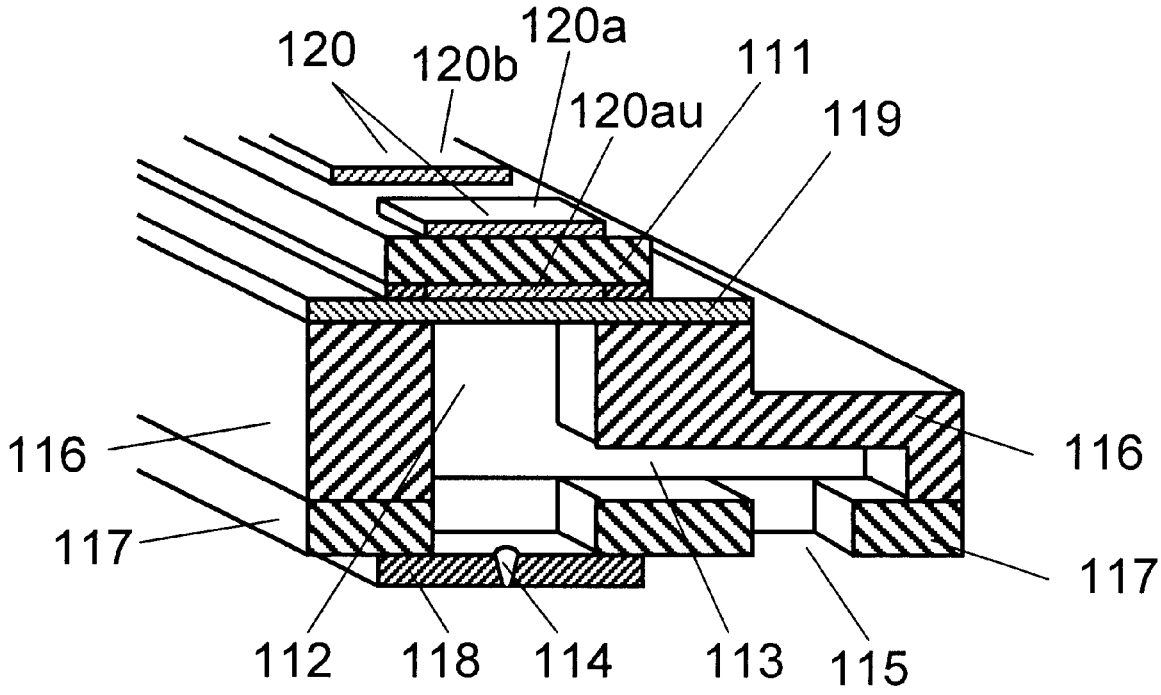
FIG. 11 (PRIOR ART)
FIG. 11 shows a sectional perspective view of a fluid ejection device of the prior art.

As shown in the description of the first exemplary embodiment, a piezoelectric thin film 108 and an elastic body 109 disposed on a MgO substrate 110 are bonded (FIG. 10D), and the MgO substrate 110 is removed by soaking in a phosphate solution (FIG. 10E). Finally, when a laminate body made of the three substrates is divided, it is diced at right angles to the longitudinal direction of the ink outlet 102 so that the opening of the ink outlet 102 can face outside (FIG. 10F).

Figure 15A:
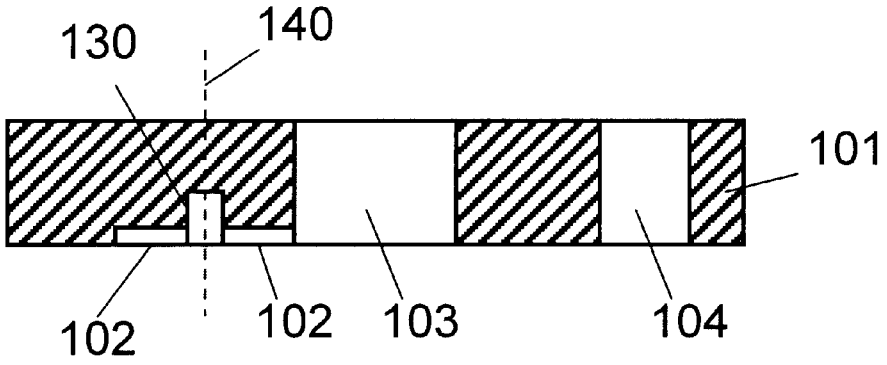
FIGS. 15A and 15B show a cross-sectional view and a plan view, respectively, of a silicon substrate processed in accordance with the second exemplary example of the present invention.
Figure 15B:
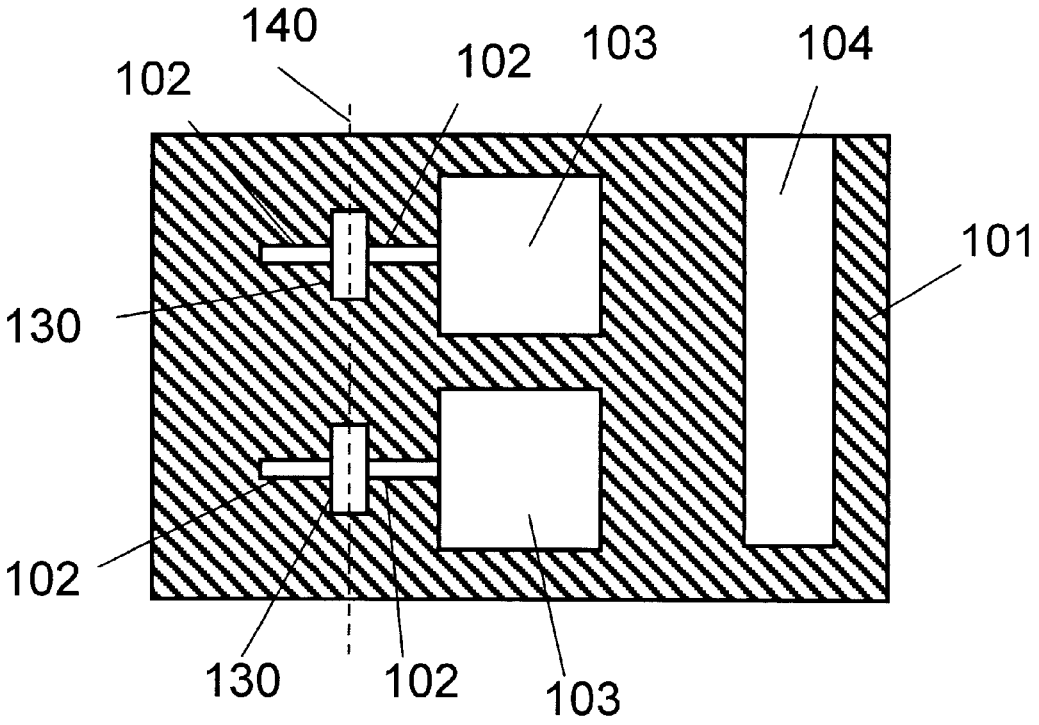

The shape of the ink outlet 102 is an important factor as it determines the fluid ejection capability. When the ink outlet 102 is very fine in shape, however, it might be chipped and the shape damaged during the dicing process discussed above. One method to avoid such damage is to cut the silicon substrate prior to forming the ink outlet by etching the silicon substrate at the point where an ink outlet is to be formed. This eliminates processing after the ink outlet is formed. When cutting causes problems in the processing of the wafer, another method can be adopted in which the portion where the ink outlet is to be formed is cut to a certain depth rather than cut completely. For example, as shown in FIG. 15A and FIG. 15B, respectively illustrating a sectional view of the silicon substrate 101 and a plan view of the same as viewed from below, a recessed portion 130 is formed on the silicon substrate 101. An ink outlet groove 102 is formed transversely of the recessed portion 130. When dividing the whole substrate, it is cut along a cutting-plane line 140 by a blade narrower than the recessed portion 130, so that the ink outlet is not processed on cutting. In FIGS. 15A and 15B, numeral 103 represents the pressure chamber, and numeral 104 an ink inlet. In the above-mentioned method, the ink outlets are formed completely at the same time as the grooves are engraved on the silicon substrate, leaving no need for processing afterwards. Thus, the shape of ink outlets are maintained uniformly and ink ejecting capability is not damaged.

With all the embodiments of the present invention, everything is formed by laminating plane members. Therefore, fine processing is easy and the structure can become finer. Further, the following efficient process can be adopted. At first a number of unit structures as shown in FIG. 9 or FIG. 15 are embedded like a matrix on a large silicon substrate as well as on first and second glass substrates. Then the substrates are bonded by a method shown in FIG. 10, and cut into individual units. In this manner, a great number of fluid ejection devices are produced at a time, making the process very efficient.

According to the exemplary embodiments discussed above, the effect of the fine processing, direct bonding and piezoelectric thin film as shown in the first exemplary embodiment, is obtained at the same time. In addition, a fluid ejection device with a different ejection mode in which fluid is ejected from an edge of a substrate can be produced. With this method, an ink outlet can be designed freely by patterning resist, which greatly contributes to the optimization of the shape. Easy, uniform and fine control of the ink outlet area is possible just by adjusting the width and depth of the groove. If an ink channel on the first glass substrate is formed by etching up to the midway of the substrate rather than penetrating completely, the second glass substrate is not necessary. Therefore, only one direct bonding step may be required to complete the process, further reducing the number of manufacturing steps.

As described so far, according to the present invention, a fluid ejection device with smaller ink outlets arranged in a higher density configuration can be formed by employing the micro-fabrication technique of silicon and glass substrates and by employing a piezoelectric thin film as described herein. As processing and lamination are conducted from a direction perpendicular to the plane of the substrate, a plurality of units may be produced, providing increased productivity and design freedom. As the substrates are directly bonded to each other, adhesive materials are not needed, simplifying process management and maximizing long-term reliability in fluid sealing capability.

As a result, an on-demand ink jet printhead for an ink jet printer with having higher nozzle density, higher reliability and lower cost can be achieved.

What is claimed is:

1. A fluid ejection device comprising;

at least one pressure chamber divided independently from other pressure chambers;

an ink channel communicating with said pressure chamber;

an ink outlet communicating with said pressure chamber; and a pressure generating section comprising a laminated body made of a piezoelectric material, an elastic body and a resin layer, said elastic body sandwiched between said piezoelectric material and said resin layer, said section covering one face of said pressure chamber;

wherein said piezoelectric material is divided into a plurality of sections with said resin layer therebetween.

2. The fluid ejection device according to claim 1, wherein said piezoelectric material has a thickness of not more than about 7 $\mu$m and said elastic body is has a thickness of the same or less than said piezoelectric material.

3. The fluid ejection device according to claim 1, wherein said pressure chamber, said ink channel and said ink outlet are defined by a structure comprising at least one planar silicon substrate laminated to at least one planar glass substrate.

4. The fluid ejection device according to claim 2, wherein said elastic body comprises a metallic material.

5. The fluid ejection device according to claim 1, wherein said piezoelectric material comprises $PbZr_xTi_{1-x}O_3$.

6. The fluid ejection device according to claim 1, further comprising a silicon substrate and a glass substrate directly bonded to one another.

7. The fluid ejection device according to claim 1 wherein the ink channel has a cross-sectional area that is about 0.5 to about 1.5 times as large as a cross-sectional area of the ink outlet.

8. The fluid ejection device according to claim 1 wherein the ink channel has a cross-sectional area that tapers towards the ink outlet.

9. The fluid ejection device according to claim 1 wherein said ink outlet is tapered from a wide end in communication with the pressure chamber to a narrow end.

10. The fluid ejection device according to claim 1, wherein said pressure chamber, said ink channel and said ink outlet are defined by a laminated structure comprising at least:

a first substrate having a through-hole for the pressure chamber and a through-hole for an ink inlet;

a second substrate having a tapered through-hole and bonded to one face of said first substrate; and a third substrate having a through-hole for the ink outlet and bonded to said second substrate.

11. The fluid ejection device according to claim 10, wherein the third substrate has a thickness of not more than about 50 $\mu$m.

12. The fluid ejection device according to claim 10 wherein the first substrate comprises a silicon single-crystal substrate, the second substrate comprises a glass substrate; and the third substrate comprises one of a glass substrate or a silicon single-crystal substrate.

13. The fluid ejection device according to claim 10 wherein:

the ink channel comprises a groove in the first substrate in communication with the through-hole for the pressure chamber and the through-hole for the ink inlet; and the second substrate having the tapered through-hole that tapers from a wide end in contact with the pressure chamber formed as the through-hole in the first substrate to a narrow end in contact with the ink outlet formed as the through-hole in the third substrate.

14. The fluid ejection device according to claim 13 wherein the through-hole in the third substrate for said ink outlet is aligned approximately on center with the narrow end of the tapered through-hole in the second substrate, said through-hole in the third substrate having a diameter smaller than a diameter of the narrow end of the tapered through-hole in the second substrate.

15. The fluid ejection device according to claim 10 wherein:

the ink channel comprises a through-hole in the first substrate;

the second substrate having the tapered through-hole tapering from a wide end in contact with the pressure chamber formed as the through-hole in the first substrate to a narrow end in contact with the ink outlet formed as the through-hole in the third substrate;

the device further comprises a fourth substrate bonded to the other face of the first substrate and having a through-hole therein for the pressure chamber and a through-hole therein for the ink inlet.

16. The fluid ejection device according to claim 15 wherein the first substrate comprises a silicon single-crystal substrate, the second substrate comprises a glass substrate; and each of the third substrate and the fourth substrate comprises one of a glass substrate or a silicon single-crystal substrate.

17. The fluid ejection device according to claim 15 wherein the through-hole in the third substrate for said ink outlet is aligned approximately on center with the narrow end of the tapered through-hole in the second substrate, said through-hole in the third substrate having a diameter smaller than a diameter of the narrow end of the tapered through-hole on the second substrate.

18. A fluid ejection device comprising;

a plurality of pressure chambers, and at least one of said plurality of pressure chambers divided independently from others of said plurality of pressure chambers;

an ink channel communicating with said pressure chamber;

an ink outlet communicating with said pressure chamber; and a pressure generating section comprising a laminated body made of a piezoelectric material, an elastic body and a resin layer, said elastic body sandwiched between said piezoelectric material and said resin layer, said section covering one face said pressure chamber;

wherein said piezoelectric material is divided into a plurality of sections with each section corresponding to a pressure chamber, said resin layer extending continuously over said pressure chambers and between said piezoelectric material where said piezoelectric material is divided into said plurality of sections.

19. A fluid ejection device comprising:

at least one pressure chamber divided independently from other pressure chambers:

an ink channel communicating with said pressure chamber;

an ink outlet communicating with said pressure chamber; and a pressure generating section comprising a laminated body made of a piezoelectric material and an elastic body, said section covering one face of said pressure chamber;

wherein said pressure chamber, said ink channel and said ink outlet are defined by a laminated structure comprising at least:

a first substrate having a through-hole for the pressure chamber and a through-hole for an ink inlet;

a second substrate having a tapered through-hole and bonded to one face of said first substrate; and a third substrate having a through-hole for the ink outlet and bonded to said second substrate;

wherein the ink channel comprises a groove in the first substrate in communication with the through-hole for the pressure chamber and the through-hole for the ink inlet; and the tapered through-hole in the second substrate tapers from a wide end in contact with the pressure chamber formed as the though-hole in the first substrate to a narrow end in contact with the ink outlet formed as the through-hole in the third substrate;

the through-hole in the third substrate for said ink outlet is aligned approximately on center with the narrow end of the tapered through-hole in the second substrate, said through-hole in the third substrate having a diameter smaller than a diameter of the narrow end of the tapered through-hole in the second substrate; and the third substrate has a thickness of not more than about 50 $\mu$m and the second substrate has a thickness of less than about 0.8 mm in a range of thickness comprising about 1.2 to about 1.9 times (rg−rs) where rg is the diameter of the wide end of the tapered though-hole in the second substrate and rs is the diameter of the narrow end of the tapered through-hole in the second substrate.

20. The fluid ejection device comprising:

at least one pressure chamber divided independently from other pressure chambers:

an ink channel communicating with said pressure chamber;

an ink outlet communicating with said pressure chamber; and a pressure generating section comprising a laminated body made of a piezoelectric material and an elastic body, said section covering one face of said pressure chamber;

wherein said pressure chamber, said ink channel and said ink outlet are defined by a laminated structure comprising:

a first substrate having a through-hole for the pressure chamber and a through-hole for an ink inlet;

a second substrate having a tapered through-hole and bonded to one face of said first substrate;

a third substrate having a through-hole for the ink outlet and bonded to said second substrate; and a fourth substrate bonded to the an other face of the first substrate and having a through-hole therein for the pressure chamber and a through-hole therein for the ink inlet;

wherein the ink channel comprises a through-hole in the first substrate;

the second substrate having the tapered through-hole tapering from a wide end in contact with the pressure chamber formed as the through-hole in the first substrate to a narrow end in contact with the ink outlet formed as the through-hole in the third substrate;

the through-hole in the third substrate for said ink outlet is aligned approximately on center with the narrow end of the tapered through-hole in the second substrate, said through-hole in the third substrate having a diameter smaller than a diameter of the narrow end of the tapered through-hole on the second substrate, and the third substrate has a thickness of not more than about 50 $\mu$m and the second substrate has a thickness of less than about 0.8 mm in a range of thickness comprising about 1.2 to about 1.9 times (rg−rs), where rg is the diameter of the wide end of the tapering through-hole formed on the second substrate and rs is the diameter of the narrow end of the tapering through-hole in the second substrate.

* * * * *

UNITED STATES PATENT AND TRADEMARK OFFICE

CERTIFICATE OF CORRECTION

PATENT NO. : 6,554,408 B1
DATED : April 29, 2003
INVENTOR(S) : Miki et al.

It is certified that error appears in the above-identified patent and that said Letters Patent is hereby corrected as shown below:

Title page,
Item [56], U.S. PATENT DOCUMENTS, please insert:

| | | | |
|---|---|---|---|
| -- 5,463,412 | 10/1995 | Matsuda | 347/43 |
| 3,921,916 | 11/1975 | Bassous | 239/601 |
| 3,958,255 | 5/1976 | Chiou et al. | 347/47 |
| 5,534,898 | 7/1996 | Kashino et al. | 347/33 |
| 3,946,398 | 3/1976 | Kyser et al. | 347/70 |
| 5,751,317 | 5/1998 | Peeters et al. | 347/65 |
| 5,984,459 | 11/1999 | Takahashi et al. | 347/70 -- |

Signed and Sealed this

Sixth Day of January, 2004

JAMES E. ROGAN
*Director of the United States Patent and Trademark Office*